United States Patent [19]

Rohner

[11] 4,079,533

[45] Mar. 21, 1978

[54] SUSPENSION FILE FOLDER

[75] Inventor: Benedikt Rohner, Zurich, Switzerland

[73] Assignee: Biella-Neher AG, Bern, Switzerland

[21] Appl. No.: 767,164

[22] Filed: Feb. 9, 1977

[30] Foreign Application Priority Data

Feb. 27, 1976 Switzerland ..... 2468/76

[51] Int. Cl.[2] ..... B42F 21/08

[52] U.S. Cl. ..... 40/359

[58] Field of Search ..... 40/359, 360, 23 A

[56] References Cited

U.S. PATENT DOCUMENTS

| | | | |
|---|---|---|---|
| 1,048,577 | 12/1912 | Pardoe | 40/359 |
| 2,438,282 | 3/1948 | Gruver et al. | 40/360 |
| 2,603,219 | 7/1952 | Jones | 40/359 |
| 2,771,076 | 11/1956 | Peter | 40/359 |
| 3,204,639 | 9/1965 | Kleffman | 40/360 |

*Primary Examiner*—Louis G. Mancene
*Assistant Examiner*—Wenceslao J. Contreras
*Attorney, Agent, or Firm*—Oblon, Fisher, Spivak, McClelland & Maier

[57] ABSTRACT

A suspension file folder characterized by one or more index tabs being detachably connectible in a plurality of differing positions to a track element secured to the upper edge of at least one side-sheet of the folder, the index tabs engaging in an upwardly open slot in the track element by means of downwardly projecting attachment members which are resilient in a plane parallel to the principal plane of the track element, a continuous slot being provided which extends along the entire length of the track element and having two sidewalls formed by the track element and a plurality of catch elements being disposed along the length of the slot between the sidewalls which cooperate with respective attachment members to form snap fastenings.

1 Claim, 2 Drawing Figures

SUSPENSION FILE FOLDER

BACKGROUND OF THE INVENTION

This invention relates to a suspension file folder of the type wherein one or more index tabs are detachably connectible in a plurality of differing positions to a track element secured to the upper edge of at least one side-sheet of the folder, the index tabs engaging in an upwardly open slot in the track element by means of downwardly projecting attachment members which are resilient in a plane parallel to the principal plane of the track element.

Besides the aforementioned type, suspension file folders are also known wherein at least one index tab, slidable along the track element, is provided with an attachment member which forms a snap fastening together with catch members in the track element, the parts forming the snap fastening engaging with and disengaging from one another at right angles to the plane of the folder side-sheet. As compared with this design, the type of suspension file folder to which the invention relates possesses the advantage that the parts forming the snap fastening are covered and do not project laterally beyond the track element, so that unintentional slipping or tearing-off can be avoided.

Suspension file folders of the kind initially described, i.e., the type to which the present invention relates, are disclosed in Swiss Patent No. 259,838. In this known design, a series of slots are provided in the track element, and the attachment members press resiliently against the edges of these slots. The significant drawback of this arrangement is that connection of the index tabs is complicated by the necessity of pressing the attachment members together before they can be inserted in the slots, thus making the index tabs quite difficult to fasten on. Moreover, a track element made of plastics does not lend itself to use for this kind of attachment.

SUMMARY OF THE INVENTION

It is an object of this invention to provide an improved suspension file folder of the type initially described, in which insertion of the index tabs is greatly facilitated, and in which the track element can also be made of plastic in a very simple way.

To this end, in the suspension file folder according to the present invention, the improvement comprises a continuous slot extending along the entire length of the track element and having two sidewalls formed by the track element, and a plurality of catch elements disposed along the length of the slot between its sidewalls, these catch elements cooperating with respective attachment members to form snap fastenings.

BRIEF DESCRIPTION OF THE DRAWINGS

A preferred embodiment of the invention will now be described in detail with reference to the accompanying drawing, in which.

DETAILED DESCRIPTION OF THE PREFERRED EMBODIMENTS

Figure 2:
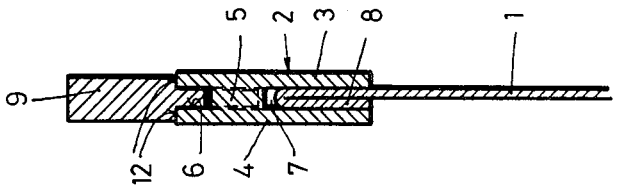
FIG. 2 is a section taken on the line II—II of FIG. 1.
Figure 1:
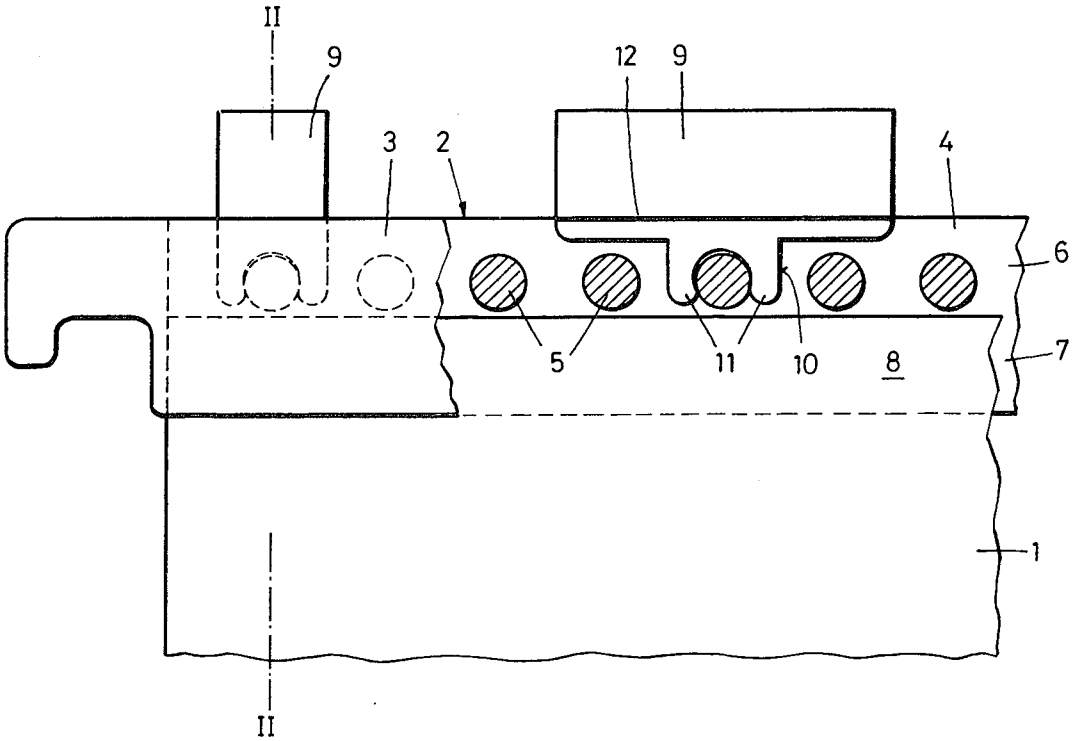
FIG. 1 is an elevation of part of a side-sheet of a suspension file folder, one side of the track element being partly broken away.

The suspension file folder illustrated in the drawing comprises a side-sheet 1 which, along its bottom edge (not shown), joins the other side-sheet (not shown) of the folder. Secured to the upper edge of the side-sheet 1 in any suitable manner, e.g., by riveting, gluing, etc., is a track element 2. It would also be possible to make both side-sheets of the folder and the track element all in one piece, e.g., of a suitable plastics material. The track element 2 is made up of two side pieces 3 and 4 joined by a plurality of disc-shaped parts 5 spaced at regular intervals from one another and acting as catch elements. When, as is preferable, the track element 2 is made of plastics, the parts 5 may be made in one piece with the side pieces 3 and 4. Thus, two slots are formed in the track element 2, viz., an upper slot 6 and a lower slot 7. In embodiments such as that illustrated in the drawing, in which the side-sheet 1 and the track element 2 are not made in one piece, e.g., of plastics, the lower slot 7 receives the folded-back upper edge 8 of the side-sheet 1 which is secured to the track element 2 within the slot 7 in any suitable manner.

Index tabs 9 each have at least one downwardly projecting attachment member 10, which in the embodiment illustrated comprises two spring legs 11. It will be seen that when an index tab is fastened in position, the legs 11 embrace a disc-shaped part 5 on both sides down to below the diameter parallel to the track element 2. Comparatively wide index tabs 9 may have two or more attachment members. The two spring legs 11 of an attachment member 10 and a part 5 together form a snap fastening which makes it possible to pull an index tab 9 upwardly off a catch element and push it down again onto another catch element situated farther along.

The depth to which the index tab 9 is inserted in the slot 6 is determined by two lateral shoulders 12 which rest upon the upper edges of the side pieces 3 and 4 when the index tab 9 is fully inserted.

In all of these embodiments, the snap fastening, i.e., the parts forming the snap connection, are covered front and back by the two side pieces 3 and 4 of the track element 2. Hence there are no parts projecting beyond the outer plane of the track element which might get caught on something when the folder is being used outside the filing cabinet; thus the risk of unintentional displacement or ripping is avoided.

What is particularly significant, however, is that the index tabs can be affixed in the simplest manner, just by inserting them, without first having to press the attachment members together, and also that it is possible to use a track element which may be easily made of plastics.

What is claimed is:

1. In a suspension file folder of the type wherein one or more index tabs are detachably connectible in a plurality of differing positions to a track element secured to the upper edge of at least one side-sheet of said folder, said index tabs engaging in an upwardly open slot in said track element by means of downwardly projecting attachment members which are resilient in a plane parallel to the principal plane of said track element, the improvement comprising:

a continuous said slot extending along the entire length of said track element and having two sidewalls formed by said track element, and a plurality of catch elements disposed along the length of said slot between said sidewalls, said catch elements cooperating with respective said attachments members to form snap fastenings.

* * * * *